US005978627A

United States Patent [19]

Masuda

[11] Patent Number: 5,978,627

[45] Date of Patent: Nov. 2, 1999

[54] METHOD AND SYSTEM FOR MEASURING SENSITIVITY OF ELECTROPHOTOGRAPHIC PHOTOCONDUCTOR

[75] Inventor: Kiyoshi Masuda, Numazu, Japan

[73] Assignee: Ricoh Company, Ltd., Tokyo, Japan

[21] Appl. No.: 09/031,658

[22] Filed: Feb. 27, 1998

[30] Foreign Application Priority Data

Mar. 7, 1997 [JP] Japan ..... 9-070686

[51] Int. Cl.[6] ..... G03G 15/00

[52] U.S. Cl. ..... 399/159; 399/47; 399/48

[58] Field of Search ..... 399/46, 47, 48, 399/50, 51, 73, 159, 177, 206, 207; 347/250, 254; 358/298, 300

[56] References Cited

U.S. PATENT DOCUMENTS 3,449,658 6/1969 Robinson et al. .

5,194,879 3/1993 Kotabe et al. ..... 347/250 X 5,565,963 10/1996 Tsujita et al. ..... 399/48

*Primary Examiner*—Matthew S. Smith

*Assistant Examiner*—Hoan Tran

*Attorney, Agent, or Firm*—Oblon, Spivak, McClelland, Maier & Neustadt, P.C.

[57] ABSTRACT

A method and system for measuring sensitivity of an electrophotography photoconductor. The sensitivity is determined using changing information of the surface potential of the photoconductor and an exposure amount information which is precisely obtained by measuring relative illuminance on the surface of the photoconductor with a photosensor disposed between a shutter performing ON/OFF operations of light and the photoconductor while the photoconductor is exposed to light. Then, a changing curve of digitized measured relative illuminance is integrated from a rising point thereof to a point thereof at a time when the surface potential information becomes a specified value.

14 Claims, 4 Drawing Sheets

METHOD AND SYSTEM FOR MEASURING SENSITIVITY OF ELECTROPHOTOGRAPHIC PHOTOCONDUCTOR

BACKGROUND OF THE INVENTION

1. Field of the Invention

The present invention relates to a method and system for measuring sensitivity of electrophotographic photoconductors.

2. Discussion of the Background

The sensitivity of electrophotographic photoconductors is generally examined prior to shipment. The determination of sensitivity of photoconductors makes it possible to know whether the photoconductors can be used for specified copying machines or printers in consideration of their image forming conditions, such as illuminance and bias voltage, or what extent of illuminance and bias voltage is needed to record good images when the photoconductors are used therein. The sensitivity of photoconductors is generally represented by one of the following:

(1) an exposure amount (illuminance×exposure time) required when a surface potential of a photoconductor is decayed from a specified value to another specified value (unit: 1x·s); and (2) an amount of surface potential decay observed when a photoconductor is exposed to light whose exposure is predetermined (unit: volt).

Typically, a photoconductor is generally exposed to light for a time on the order of a few seconds to examine its sensitivity.

Photoconductors mounted in analog copying machines are generally exposed to light for a time on the order of from tens of milliseconds to hundreds of milliseconds. Therefore, sensitivity of these photoconductors is needed to be examined with such a short pulse light to know whether the photoconductors can respond thereto. In this case, an exposure time is controlled so as to be, for example, 1/30, 1/60 or 1/125 second using a mechanical electromagnetic shutter.

Before sensitivity is examined, illuminance of light used for measuring sensitivity is generally measured using continuous light at the surface position of a photoconductor while opening a shutter. The thus obtained illuminance is multiplied by an exposure time to obtain an exposure amount.

In this case, since a mechanical shutter is used to control the exposure time, it takes a few milliseconds from a time when the shutter begins to open until the shutter is completely opened. In addition, it also takes almost the same time when the shutter is closed. Therefore, the exposure amount cannot be exactly measured unless such transition times are taken into consideration. In fact, background methods for examining sensitivity are imprecise particularly when the exposure time is relatively short.

Another method for measuring an exposure amount is used in which a sudden decay starting point of a light decay curve of surface potential of a photoconductor is considered to be a starting point of the exposure, the exposure time is defined as a period of time from the sudden decay starting point to a time when the surface potential becomes a predetermined surface potential, and the exposure amount is obtained as a product of the exposure time and the illuminance. However, among photoconductors for use in digital copying machines, there are photoconductors with a surface potential which does not suddenly decay soon after light is irradiated thereto and which suddenly decays after a certain amount of light is irradiated thereto. Therefore, this method for measuring an exposure amount is imprecise particularly when sensitivity of such photoconductors is measured.

In attempting to exactly determine a starting time of exposure, several methods have been proposed. One of them is to define the starting time as a time when the shutter opening operation is ordered. However, this method has a drawback in that it takes a considerable time from the order until the shutter actually begins to start. Another method is to define the starting time as a time when a signal that a shutter is in an opened state is output by a contact point of the shutter. However, this method has a drawback in that there are variations in the time when the signal is output because this method also uses a mechanical mechanism. In addition, these methods also have the above-mentioned drawback that an exposure amount during shutter opening and closing operations cannot be exactly determined.

Further, another method has been proposed in which the relationship between illuminance and a detected current of a photo-sensor is previously obtained while using an integral circuit to determine exact exposure amount. Even in this case, a starting time of exposure cannot be exactly determined, and therefore the exposure amount cannot be exactly determined.

SUMMARY OF THE INVENTION

Accordingly, the Applicants of the present invention have realized that a need exists for a method for measuring sensitivity of a photoconductor in which sensitivity of a photoconductor can be simply and exactly measured even when the exposure time is as short as a time on the order of a few milliseconds.

Accordingly, one object of the present invention is to provide a novel method and system for measuring sensitivity of an electrophotographic photoconductor in which sensitivity of a photoconductor can be simply and exactly measured even when the exposure time is as short as a time on the order of a few milliseconds.

Briefly this object and other objects of the present invention as hereinafter will become more readily apparent can be attained by a method and system which includes the following steps and operations:

(1) charging a photoconductor with a charging device;

(2) exposing the charged photoconductor to light which is preferably pulsed using a shutter;

(3) obtaining changing information of the surface potential of the photoconductor using a surface potential meter while the photoconductor is exposed to light, and then obtaining a digitized changing curve of the surface potential of the photoconductor;

(4) measuring illuminance (relative illuminance) on the surface of the photoconductor with a photo-sensor while the photoconductor is exposed to light, and then obtaining a digitized changing curve of the relative illuminance;

(5) obtaining the exposure amount by integrating the changing curve of the relative illuminance; and (6) determining sensitivity, for example, as an exposure amount when the surface potential of the photoconductor is decayed from a specified value V1 to another specified value V2.

In order to exactly measure the exposure amount, the method and system of the present invention may also include the following features:

(1) relative illuminance on the surface of the photoconductor is measured with a photo-sensor which is disposed between the shutter and the photoconductor while the photoconductor is exposed to light; and (2) a rising point of the changing curve of the relative illuminance is defined as a starting time of the exposure.

The total exposure amount E can be obtained by the following equation (1):

$$E = \frac{K}{2Pm}\left(\sum_{i=w}^{s-1} Pi + Pi + 1\right)\Delta t \quad (1)$$

wherein K represents a preliminarily measured illuminance value on the surface of the photoconductor; Pm represents an average value of a plateau of the changing curve of the relative illuminance; Pi represents a digitized value corresponding to relative illuminance when the sampling number is i; Δt represents a sampling interval; and w and s represent a rising point of the changing curve of the relative illuminance and a point of the changing curve of the relative illuminance at a time when the surface potential becomes the specified value V2, respectively.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
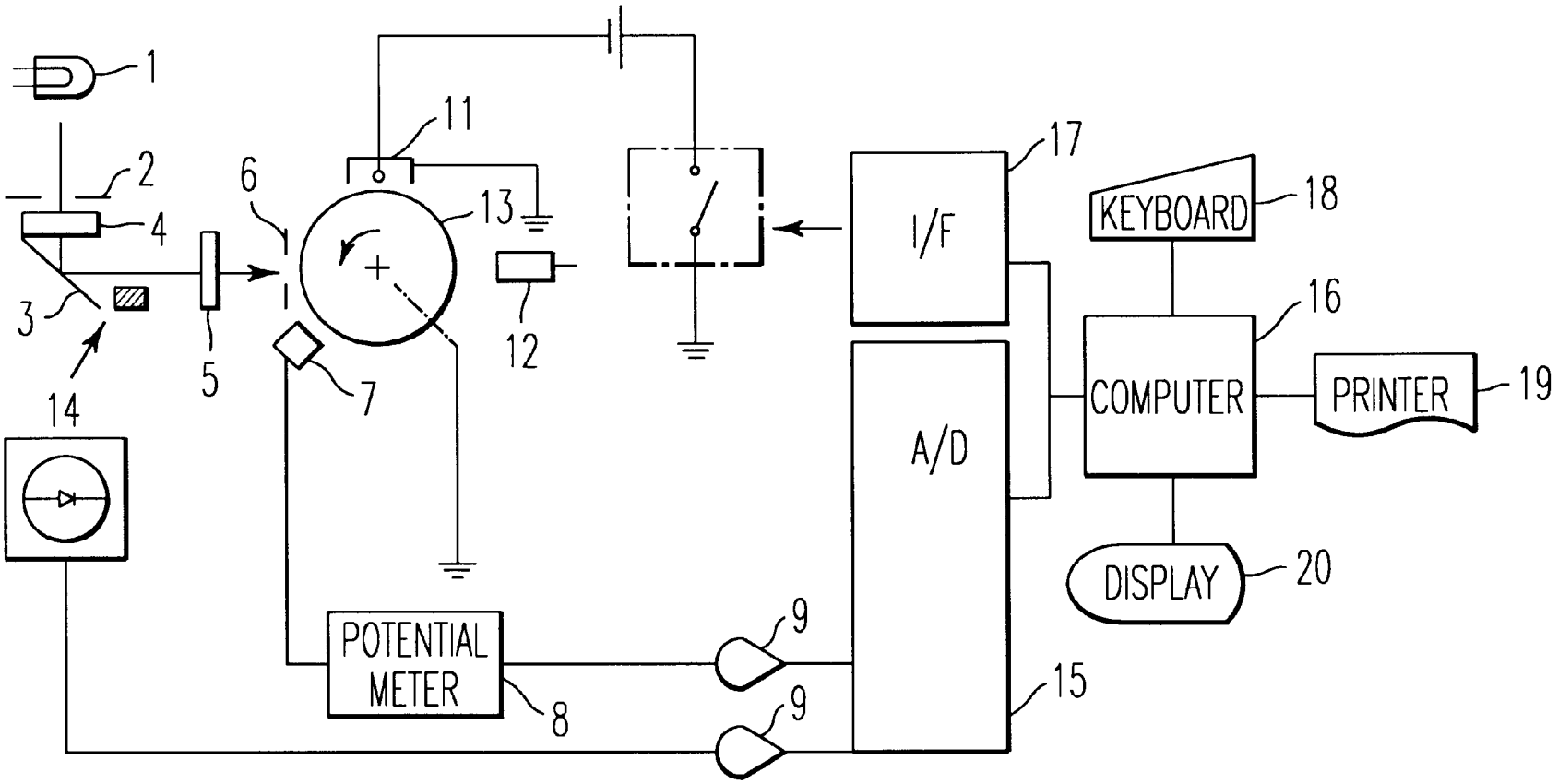
FIGS. 1A and 1B are schematic diagrams illustrating systems for measuring sensitivity of a photoconductor using a method of the present invention.

FIG. 1A is a schematic diagram illustrating an embodiment of a system suitable for measuring sensitivity of a photoconductor using a method of the present invention. Light emitted from a light source 1, e.g., a lamp, is controlled in light quantity by a mechanical diaphragm 2 and is irradiated onto a photoconductive drum (specimen) 13 via a diffuse reflection plate 3, a shutter 4, a filter 5, and a slit 6. A charger 11 for charging the photoconductive drum 13, a probe 7 of a surface potential meter 8, and a discharging lamp 12 for eliminating a residual charge of the photoconductive drum 13 are disposed around the photoconductive drum 13.

Figure 1B:
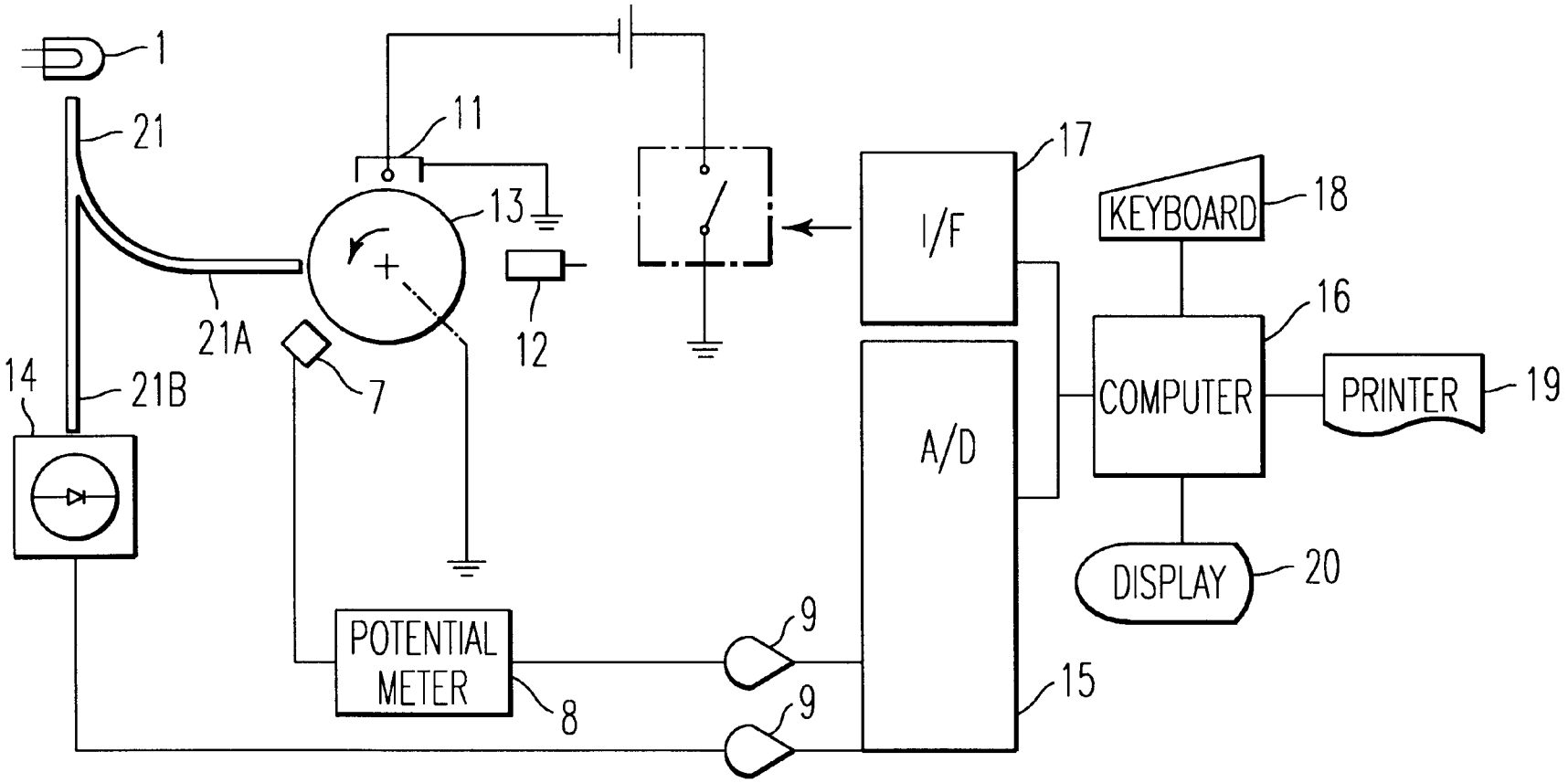

A photo-sensor 14 can be disposed at any place between the shutter 4 and the photoconductive drum 13 to measure illuminance. Shutter 4 can be omitted, and when pulse light, such as light emitted from light source 1, which as examples may be a xenon flush lamp or laser light, is irradiated without using shutter 4, the photo-sensor 14 can be disposed at any place between the light source 1 and the photoconductive drum 13. When the photo-sensor 14 is disposed on the way of a light path, it is preferable to use as small a photo-sensor 14 as possible so as not to adversely affect the illuminance on the photoconductive drum 13. As shown in FIG. 1B, a light guide 21 can also be used for irradiating light, and if a light guide 21 is used for irradiating light, a bifurcated light guide is preferably used because one guide 21A can be used for irradiating the photoconductive drum 13 and the other guide 21B can be used for measuring illuminance with the photo-sensor 14.

An output of the photo-sensor 14 is input to an A/D converter 15 via an amplifier 9. It is preferable to use an A/D converter 15 which can sample both of an output of the surface potential meter 8 and an output of the photo-sensor 14 at the same time. In addition, it is preferable to use an A/D converter 15 which can independently sample outputs of the photo-sensor 14 and the surface potential meter 8 in respective sampling frequency. This is because the sampling frequency of the output of the photo-sensor 14 should be set to be relatively large compared to that of the surface potential meter 8 since a time in which the photo-sensor 14 receives the irradiated light is on the order of tens of milliseconds while a time in which the surface potential meter 8 measures the surface potential of the photoconductive drum 13 is on the order of from hundreds of milliseconds to a few seconds. Reference numerals 17, 18, 19 and 20 represent an interface (I/F) such as a TTL (transistor-transistor logic), a keyboard, a printer and a display, respectively. Reference numeral 16 represents a computer, or other type of controller, processor, etc.

Figure 5:
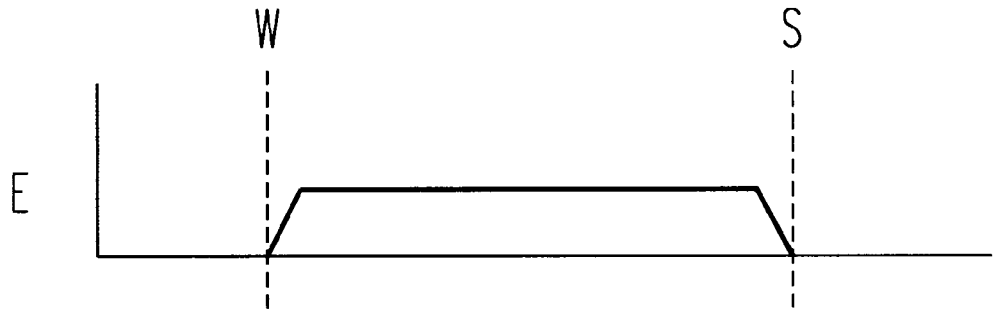
FIG. 5 is a chart illustrating a changing curve of relative illuminance obtained using a method of the present invention.

In FIG. 5, a total exposure amount E of the photoconductive drum 13 can be obtained by the following equation (1):

$$E = \frac{K}{2Pm}\left(\sum_{i=w}^{s-1} Pi + Pi + 1\right)\Delta t \quad (1)$$

wherein Pi represents a digitized value of relative illuminance when the sampling number is i; Δt represents a sampling interval; and w and s represent a rising point and an end point of the relative illuminance changing curve, respectively; Pm represents an average value of a plateau of the relative illuminance changing curve; and K represents illuminance which is preliminarily measured using continuous light.

The photo-sensor 14 is disposed at a place which is between the shutter 4 and the photoconductive drum 13 and which is considerably apart from the surface of the photoconductive drum 13 so that the photo-sensor 14 does not adversely affect the illuminance at the surface position of the photoconductive drum 13. An output current of the photo-sensor 14 is converted to a voltage using a resistor and is then input to the A/D converter 15 via the amplifier 9. Response time of the photo-sensor 14 is preferably on the order of a few microseconds. In addition, the relationship between a voltage converted from an output current of the photo-sensor 14 and illuminance on the surface of the photoconductive drum 13 may be previously obtained to determine illuminance on the surface of the photoconductive drum 13.

As mentioned above, the A/D converter 15 is preferably one which can sample both outputs of the photo-sensor 14 and the surface potential meter 8 at the same time and at each respective sampling frequency.

Figure 2:
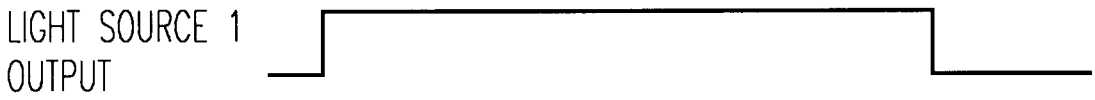
FIG. 2 is a timing chart illustrating timing at which a lamp is irradiating as a feature of the present invention.
Figure 3:
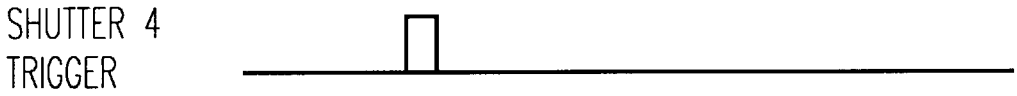
FIG. 3 is a timing chart illustrating timing at which a shutter is triggered to open to irradiate pulse light as a feature of the present invention.
Figure 4:
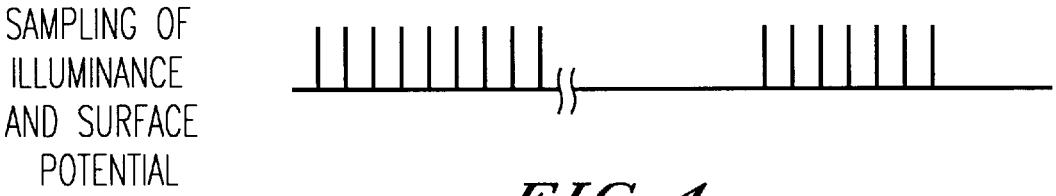
FIG. 4 is a timing chart illustrating timing at which data of relative illuminance and surface potential are sampled as a feature of the present invention.

Timings in the measurements of sensitivity are illustrated in FIGS. 2, 3 and 4. FIGS. 2, 3 and 4 illustrate timing in which the light source 1 is irradiating (FIG. 2), timing in which the shutter 4 is triggered to open (FIG. 3), and timing in which outputs of relative illuminance and surface potential are sampled (FIG. 4), respectively.

The data of the relative illuminance and the surface potential can be stored in a memory and are then transferred to computer 16 after the measurements are finished, and are then processed using a program according to the algorithm mentioned above to obtain a total exposure amount E. An example of the changing curve of the relative illuminance is illustrated in FIG. 5.

The sensitivity of the photoconductive drum 13 is obtained, for example, by one of the following methods:

(1) an exposure amount (illuminance×exposure time) required when surface potential of a photoconductor is decayed from a specified value V1 to another specified value V2 (unit: 1x·s); and (2) an amount of surface potential decay observed when a photoconductor is exposed to light whose exposure amount is predetermined (unit: volt).

On the other hand, a background method for measuring a total exposure amount when sensitivity of a photoconductor is measured is as follows:

(1) an exposure time needed for decaying a specified amount of a surface potential of the photoconductor is obtained by counting the number of sampling data of the surface potential and multiplying it by a sampling interval Δt; and (2) an exposure amount is obtained by multiplying the exposure time by illuminance value which is preliminary measured using continuous light.

Having generally described the present invention, further understanding can be obtained by reference to certain specific examples which are provided herein for the purpose of illustration only and are not intended to be limiting.

EXAMPLES

Example 1

Sensitivity of a photoconductive drum 13 was measured using a system illustrated in FIG. 1. A photo-diode 1336-8 BK which was manufactured by Hamamatsu Photonics Co., Ltd. and which was connected with a resistor of 1 KΩ was used as the photo-sensor 14, and Multi-programmer 6942A which was manufactured by Hewlett-Packard Co. and which included two sets of each of an A/D conversion board, a pulse array generating board and a memory board was used as the A/D converter 15. In addition, an electromagnetic shutter No. 0 manufactured by Copal Co., Ltd. was used as the shutter 4, and TREK 362A manufactured by TREK Inc. was used as the surface potential meter 8 having the probe 7.

Measurements conditions were as follows:

(1) a lamp KP-8 manufactured by Nippon Philips Co., Ltd. serving as the light source 1 was turned on when the charging was started, and then turned off when the measurements of sensitivity were finished;

(2) an open time of the shutter 4 was 1/60 second;

(3) a sampling interval was 0.1 millisecond (10 kHz);

(4) each of a photoconductive drum (I) which was manufactured by Ricoh Co., Ltd. for Imagio MF-530, and a photoconductive drum (II) which was manufactured by Ricoh Co., Ltd. for a digital copier and which included a single-layer type Cu-Pc photoconductive layer useful for positive charging were used as the photoconductive drum 13;

(5) each illuminance on the surface of the photoconductive drums (I) and (II) was 80 1x and 120 1x , respectively, which was measured with a photometer T-1M manufactured by Minolta Co., Ltd. while the shutter 4 was in an opened state;

(6) the photoconductive drum (I) was charged while rotating, and when the surface potential was −800 V, the rotation of the photoconductive drum (I) was stopped and pulse light was irradiated to the photoconductive drum (I) to measure the sensitivity thereof; and (7) the sensitivity of the photoconductive drum (II) was measured in the same way as that mentioned in (6) except that the photoconductive drum (II) was charged so that the surface potential was +600 V.

In this case, the total exposure amount was 1.531 1x·s for the photoconductive drum (I) which was measured by the method of the present invention during the exposure of 1/60 second whereas it was 1.331 1x·s when measured by the background method mentioned above. The difference between the two values was about 15% which was not negligible.

Figure 6:
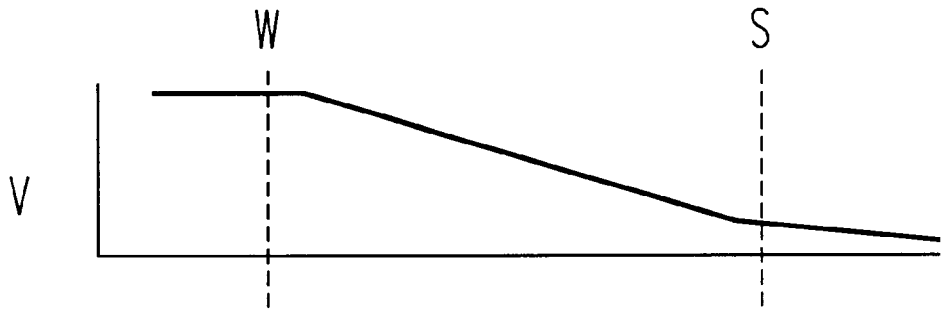
FIG. 6 is a chart illustrating a light decay curve of surface potential of a photoconductor of the present invention.
Figure 7:
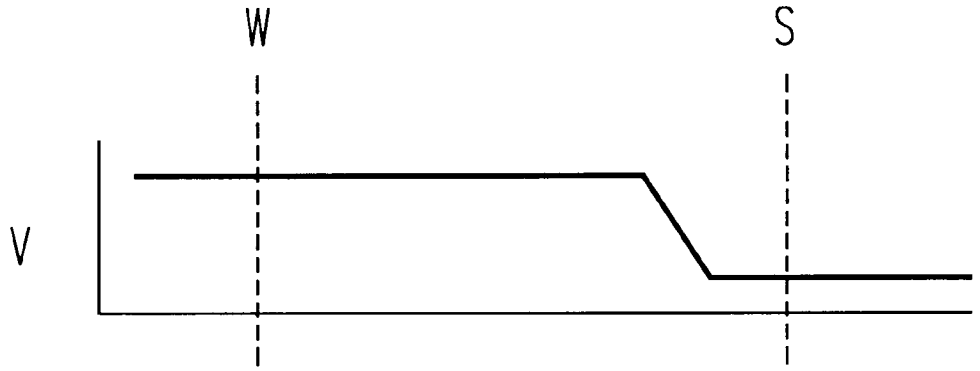
FIG. 7 is a chart illustrating a light decay curve of surface potential of another photoconductor of the present invention.

The sensitivity of the photoconductive drum (I) was defined as a total exposure amount needed for decaying the surface potential thereof from −800 V to −100 V, which is shown in FIG. 6. The sensitivity of the photoconductive drum (II) was defined as a total exposure amount needed for decaying the surface potential thereof from +600 V to +100 V, which is shown in FIG. 7.

The results are shown in Table I.

TABLE I

| Photoconductive drum | Sensitivity measured by the method of the present invention | Sensitivity measured by the background method |
|---|---|---|
| (I) | 1.231 1x · s | 1.351 1x · s |
| (II) | 2.031 1x · x | 0.311 1x · s |

The sensitivity of the photoconductive drum (I) according to the method of the present invention was obtained by measuring a total exposure amount E which was obtained from equation (1) by integrating the changing curve of the relative illuminance from a rising point thereof to a point thereof at a time when the surface potential became −100 V.

The sensitivity of the photoconductive drum (II) was also measured in the same way except that the surface potential was changed to +100 V.

The sensitivity of the photoconductive drum (I) according to the background method was obtained as a product of the time which was needed for decaying the surface potential from −800 V to −100 V and the illuminance measured using continuous light. The sensitivity of the photoconductive drum (II) measured by the background method was also obtained in the same way except that each of the starting point and the ending point of the surface potential were set to +600 V and +100 V, respectively. In these cases, it was observed that the decay of the surface potential caused by the exposure had been finished before the light was stopped to irradiate the photoconductive drums, namely, before the shutter 4 was closed.

The results in Table I clearly indicate that the sensitivity measured by the method of the present invention is precise.

This application is based on Japanese Patent Application No. 09-070686, filed on Mar. 7, 1997, incorporated therein by reference.

Obviously, numerous modifications and variations of the present invention are possible in light of the above teachings. It is therefore to be understood that within the scope of the appended claims, the present invention may be practiced otherwise than as specifically described herein.

I claim:

1. A method for measuring sensitivity of an electrophotographic photoconductor comprising the steps of:

charging the photoconductor;

irradiating light to the photoconductor after stopping the charging;

measuring surface potential of the photoconductor at least while the photoconductor is exposed to light to obtain changing information of the surface potential; and measuring relative illuminance on a surface of the photoconductor with a photo-sensor while the photoconductor is exposed to light to obtain exposure amount information; and determining sensitivity of the photoconductor using the changing information of the surface potential and the exposure amount information.

2. The method for measuring sensitivity of an electrophotographic photoconductor according to claim 1, wherein the light is pulsed using a shutter, and wherein the photo-sensor is disposed between the shutter and the photoconductor.

3. The method for measuring sensitivity of an electrophotographic photoconductor according to claim 1, wherein the relative illuminance is measured using a light guide having, at least first and second guides, wherein the first guide guides light for measuring the relative illuminance and the second guide guides light for exposing the photoconductor to light.

4. The method for measuring sensitivity of an electrophotographic photo conductor according to claim 2, wherein the relative illuminance is measured using a light guide having at least first and second guides, wherein the first guide guides light for measuring the relative illuminance and the second guide guides light for exposing the photoconductor to pulsed light.

5. The method for measuring sensitivity of an electrophotographic photoconductor according to claim 1, wherein the method further includes a step of measuring illuminance on the surface of the photoconductor, and wherein the step of irradiating light comprises the substep of:

starting to irradiate the photoconductor at a time when the surface potential is a specified value V1;

wherein the steps of measuring surface potential and relative illuminance comprise the substep of:

digitizing the measured relative illuminance and surface potential to obtain a changing curve of the relative measured illuminance and a changing curve of the surface potential, respectively; and wherein the step of determining sensitivity comprises the substep of:

determining the sensitivity as an exposure amount required when the surface potential of the photoconductor is decayed from the specified value V1 to another specified value V2, and wherein the exposure amount is a total exposure amount E which is obtained by the following equation (1):

$$E = \frac{K}{2Pm}\left(\sum_{i=w}^{s-1} Pi + Pi + 1\right)\Delta t \tag{1}$$

wherein K represents the measured illuminance; Pm represents an average value of a plateau of the changing curve of the measured relative illuminance; Pi represents a digitized value of sampled measured relative illuminance when the sampling number is i; Δt represents a sampling interval; and w and s represent a rising point of the changing curve of the measured relative illuminance and a point of the changing curve of the measured relative illuminance at a time when the surface potential becomes the specified value V2, respectively.

6. The method for measuring sensitivity of an electrophotographic photoconductor according to claim 2, wherein the method further includes a step of measuring illuminance on the surface of the photoconductor, wherein the step of irradiating light comprises the substep of:

starting to irradiate the photoconductor at a time when the surface potential is a specified value V1;

wherein the steps of measuring surface potential and relative illuminance comprise the substep of:

digitizing the measured relative illuminance and surface potential to obtain a changing curve of the relative measured illuminance and a changing curve of the surface potential, respectively; and wherein the step of determining sensitivity comprises the substep of:

determining the sensitivity as an exposure amount required when the surface potential of the photoconductor is decayed from the specified value V1 to another specified value V2, and wherein the exposure amount is a total exposure amount E which is obtained by the following equation (1):

$$E = \frac{K}{2Pm}\left(\sum_{i=w}^{s-1} Pi + Pi + 1\right)\Delta t \tag{1}$$

wherein K represents the measured illuminance; Pm represents an average value of a plateau of the changing curve of the measured relative illuminance; Pi represents a digitized value of sampled measured relative illuminance when the sampling number is i; Δt represents a sampling interval; and w and s represent a rising point of the changing curve of the measured relative illuminance and a point of the changing curve of the measured relative illuminance at a time when the surface potential becomes the specified value V2, respectively.

7. The method for measuring sensitivity of an electrophotographic photoconductor according to claim 2, wherein the method further includes a step of measuring illuminance on the surface of the photoconductor, wherein the steps of measuring relative illuminance and surface potential comprise the substep of:

digitizing the measured relative illuminance and surface potential to obtain a changing curve of the relative measured illuminance and a changing curve of the surface potential, respectively; and wherein the step of determining sensitivity comprises the substep of:

determining the sensitivity as an amount of surface potential decay observed when the photoconductor is exposed to light whose exposure amount E is predetermined and determined by the following equation (2):

$$E = \frac{K}{2Pm}\left(\sum_{i=w}^{s-1} Pi + Pi + 1\right)\Delta t \quad (2)$$

wherein K represents the measured illuminance; Pm represents an average value of a plateau of the changing curve of the measured relative illuminance; Pi represents a digitized value of sampled measured relative illuminance when the sampling number is i; Δt represents a sampling interval; and w and s' represent a rising point of the changing curve of the measured relative illuminance and an end point of the changing curve of the measured relative illuminance, respectively.

8. A system for measuring sensitivity of an electrophotographic photoconductor comprising:

a charger which charges the photoconductor;

a light source which irradiates light to the photoconductor;

a photo-sensor which measures relative illuminance on the surface of the photoconductor to obtain exposure amount information while the photoconductor is exposed to light; and a surface potential measuring device which measures surface potential of the photoconductor at least while the photoconductor is exposed to light to obtain changing information of the surface potential, wherein sensitivity of the photoconductor is determined using the exposure amount information and the changing information of the surface potential.

9. The system for measuring sensitivity of an electrophotographic photoconductor according to claim 8, wherein the system further comprises a shutter which is disposed between the light source and the photoconductor, and wherein the light is pulsed using the shutter.

10. The system for measuring sensitivity of an electrophotographic photoconductor according to claim 8, wherein the system further comprises a light guide having at least first and second guides, where the first guide guides light for measuring the relative illuminance and the second guide guides light for exposing the photoconductor to light.

11. The system for measuring sensitivity of an electrophotographic photoconductor according to claim 9, wherein the system further comprises a light guide having at least first and second guides, where the first guide guides light for measuring the relative illuminance and the second guide guides light for exposing the photoconductor to pulsed light.

12. The system for measuring sensitivity of an electrophotographic photoconductor according to claim 8, wherein the system further comprises:

an illuminance measuring device which measures illuminance on the surface of the photoconductor; and an A/D converter which converts signals of the relative illuminance and the surface potential, which are output by the photo-sensor and the surface potential measuring device, respectively, to digital forms to obtain a changing curve of the relative illuminance and a changing curve of the surface potential; and wherein the light starts to irradiate the photoconductor at a time when the surface potential is a specified value V1, and wherein the sensitivity is determined as an exposure amount required when the surface potential of the photoconductor is decayed from the specified value V1 to another specified value V2, and wherein the exposure amount is a total exposure amount E which is obtained by the following equation (1):

$$E = \frac{K}{2Pm}\left(\sum_{i=w}^{s-1} Pi + Pi + 1\right)\Delta t \quad (1)$$

wherein K represents the measured illuminance; Pm represents an average value of a plateau of the changing curve of the measured relative illuminance; Pi represents a digitized value of sampled measured relative illuminance when the sampling number is i; Δt represents a sampling interval; and w and s represent a rising point of the changing curve of the measured relative illuminance and a point of the changing curve of the measured relative illuminance at a time when the surface potential becomes the specified value V2, respectively.

13. The system for measuring sensitivity of an electrophotographic photoconductor according to claim 9, wherein the system further comprises:

an illuminance measuring device which measures illuminance on the surface of the photoconductor while opening the shutter; and an A/D converter which converts signals of the relative illuminance and the surface potential, which are output by the photo-sensor and the surface potential measuring device, respectively, to digital forms to obtain a changing curve of the relative illuminance and a changing curve of the surface potential; and wherein the pulsed light starts to irradiate the photoconductor at a time when the surface potential is a specified value V1, and wherein the sensitivity is determined as an exposure amount required when the surface potential of the photoconductor is decayed from the specified value V1 to another specified value V2, and wherein the exposure amount is a total exposure amount E which is obtained by the following equation (1):

$$E = \frac{K}{2Pm}\left(\sum_{i=w}^{s-1} Pi + Pi + 1\right)\Delta t \quad (1)$$

wherein K represents the measured illuminance; Pm represents an average value of a plateau of the changing curve of the measured relative illuminance; Pi represents a digitized value of sampled measured relative illuminance when the sampling number is i; Δt represents a sampling interval; and w and s represent a rising point of the changing curve of the measured relative illuminance and a point of the changing curve of the measured relative illuminance at a time when the surface potential becomes the specified value V2, respectively.

14. The system for measuring sensitivity of an electrophotographic photoconductor according to claim 9, wherein the system further comprises:

an illuminance measuring device which measures illuminance on the surface of the photoconductor while opening the shutter; and an A/D converter which converts signals of the relative illuminance and the surface potential, which are outputted by the photo-sensor and the surface potential measuring device, respectively, to digital forms to obtain a changing curve of the relative illuminance and a changing curve of the surface potential; and wherein the sensitivity is determined as an amount of surface potential decay observed when the photoconductor is exposed to light whose exposure amount is predetermined and determined by the following equation (2):

$$E = \frac{K}{2Pm}\left(\sum_{i=w}^{s'-1} Pi + Pi + 1\right)\Delta t \quad (2)$$

wherein K represents measured the illuminance; Pm represents an average value of a plateau of the changing curve of the measured relative illuminance; Pi represents a digitized value of sampled measured relative illuminance when the sampling number is i; Δt represents a sampling interval; and w and s' represent a rising point of the changing curve of the measured relative illuminance and an end point of the changing curve of the measured relative illuminance, respectively.

* * * * *